US005385154A

United States Patent [19]

Fuhrman et al.

[11] Patent Number: 5,385,154

[45] Date of Patent: Jan. 31, 1995

[54] COUPLE'S INTIMACY RECIPROCATING AND PIVOTING TWO SEAT ASSEMBLY

[76] Inventors: Andrew M. Fuhrman; Roxanne S. Fuhrman, both of 119 Edgewater Dr., Edgewater, Md. 21037

[21] Appl. No.: 147,842

[22] Filed: Nov. 4, 1993

[51] Int. Cl.[6] ..... A61G 15/00; A47C 3/00; A61F 5/00

[52] U.S. Cl. ..... 128/845; 297/246; 600/38; 128/846

[58] Field of Search ..... 128/845, 25 R, 33, 846; 297/246, 245; 482/906, 72, 73; 114/363; 440/104, 90, 21; 600/38–41

[56] References Cited

U.S. PATENT DOCUMENTS

| | | | |
|---|---|---|---|
| 336,220 | 2/1886 | Farrar . | |
| 715,668 | 12/1902 | Kiddie | 297/245 |
| 2,602,485 | 7/1952 | Alloway . | |
| 3,951,449 | 4/1976 | Crowther . | |
| 4,099,773 | 7/1978 | Chang | 128/33 |
| 4,176,415 | 12/1979 | Dickerson et al. | 128/33 |
| 4,290,155 | 9/1981 | Hanson . | |
| 4,648,141 | 3/1987 | Mansouris et al. . | |
| 4,650,249 | 3/1987 | Serber . | |
| 4,699,423 | 10/1987 | Fitzig et al. | 297/245 |
| 4,884,842 | 12/1989 | Finkelstein . | |
| 5,113,851 | 5/1992 | Gamba | 128/33 |

*Primary Examiner*—Robert A. Hafer
*Assistant Examiner*—Michael O'Neill
*Attorney, Agent, or Firm*—Lalos & Keegan

[57] ABSTRACT

An intimacy chair assembly and method to assist a human couple to engage in sexual intercourse with reduced effect of gravity or the reduced expenditure of substantial energy including a pair of facing seats for the couple, the assembly being capable of reciprocating movement of at least one seat selectively continually toward and away from the other seat in a substantially longitudinal direction and of selectively continually pivoting said one seat about an upright axis.

25 Claims, 3 Drawing Sheets

COUPLE'S INTIMACY RECIPROCATING AND PIVOTING TWO SEAT ASSEMBLY

BACKGROUND

At the present time and through all recorded history, a bed of one form or another has been the place where human couples have had sexual intercourse. It requires that both individuals support their own weight and often bear the weight of their partner, requiring great expenditure of energy as well as the use of the hands and considerable body control, just to gain advantageous access to one another.

Beds are disadvantageous and restricting due to difficulties in achieving and maintaining a favorable position for a sustained period. Sexual intimacy on a conventional bed requires a great expenditure of energy due to the bed's limitations. Persons of decreased or diminished physical ability may not be able to function well or at all in a bed. Generally, beds restrict access to one another due to the mechanical difficulties a two dimensional mattress surface presents the couple.

The desire or need for intimacy remains a strong impulse for couples but the energy, strength and balance requirements may limit or destroy a couple's chance for intimacy. Those who are aged, infirm, handicapped, such as through loss of a limb, for example, or otherwise physically unable to engage in sexual intercourse with their partner to the extent desired present a real need that has not been fulfilled in the past.

SUMMARY OF THE INVENTION

This invention provides a working system for a human couple for overcoming many of the mechanical and physical difficulties in achieving and maintaining an advantageous position during sexual intercourse. It further provides the couple with a means of a new enhancement: selectively controlled and mutually facing seats support the man and the woman in similar planes or different planes; both individuals may select to pivot vertically or horizontally about an upright axis and may move in continuous reciprocal and substantially longitudinal motion, thereby achieving improved mobility. The couple experiences a new ability to create and control movement with little or no effort during intercourse which cannot be achieved and maintained in a bed. They exert negligible energy in supporting their bodies.

DESCRIPTION OF THE PREFERRED EMBODIMENT

Figure 1:
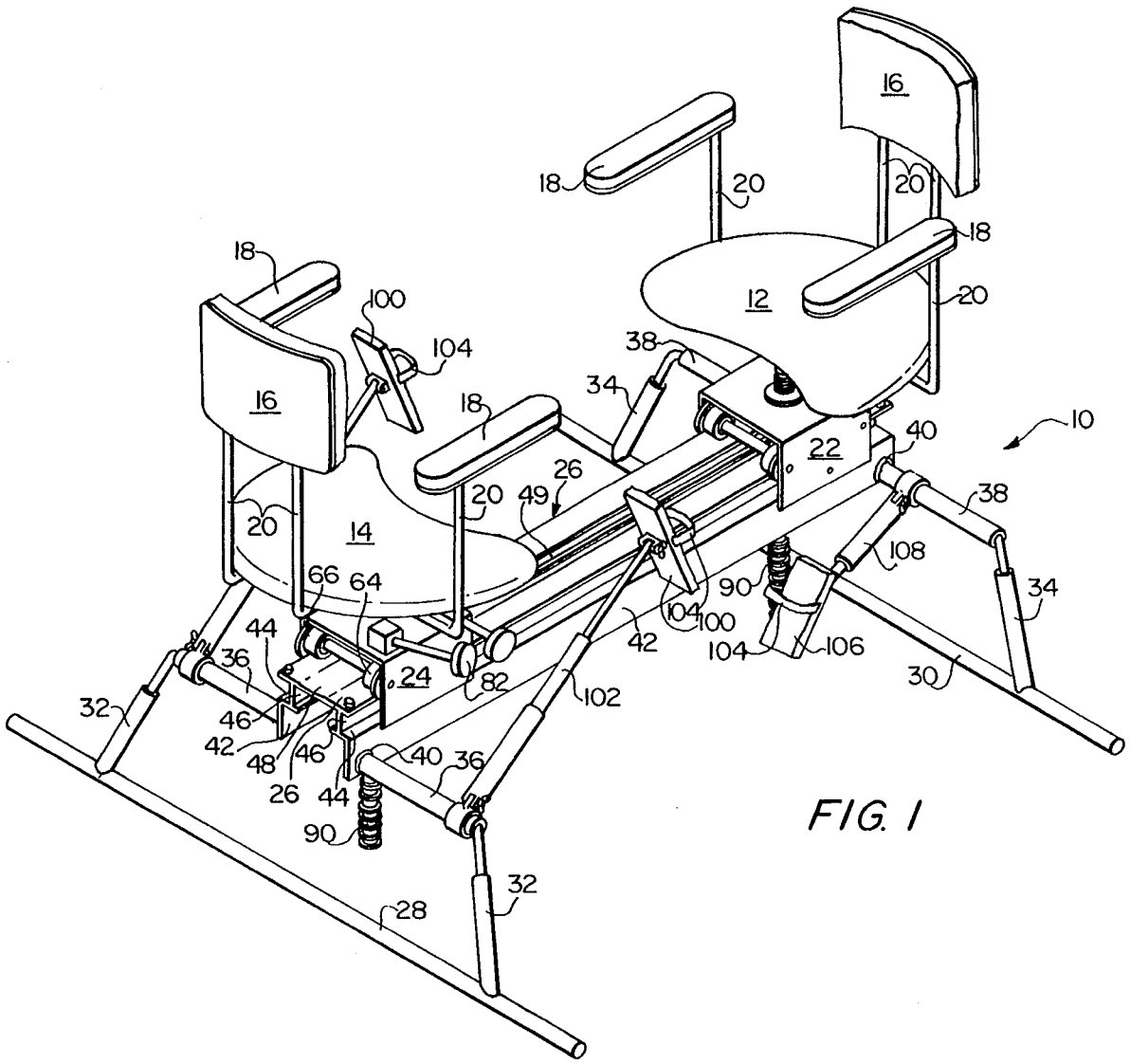
FIG. 1 is a perspective view of the couple's intimacy chair assembly of the present invention illustrating the facing chairs to seat the couple and the track enabling reciprocal movement along with the height adjustments and other controls.

The couple's chair assembly 10 as shown in perspective in FIG. 1 and illustrates a pair of facing seats 12 and 14 for the woman and man respectively. Each seat has a backrest 16 and arms 18 secured to the underside of their respective seats by support members 20.

The seats are supported in a unique manner on dolly assemblies 22 and 24 that roll on rails 26. Rails 26 are supported by base rods 28 and 30 that are positioned on the ground and support the entire assembly 10.

Protruding from each of the base rods 28 and 30 are a pair of upstanding angled rods 32,32 and 34,34 that may be adjustable vertically by means not shown and angled inwardly to meet upper horizontal support rods 36,36 secured to respective angled rods 32,32 and similarly at the opposite end of the assembly similar horizontal support rods 38,38 for connection with the angled rods 34,34. The rods 36,36 and 38,38 are welded as at 40 to a pair of parallel support beams 42,42 that have a shape of an inverted L. Supported on the inner legs 44,44 forming the horizontal portion of the support beams 42 is the upside down U-shaped rail 26 having a pair of vertical upstanding legs 46,46 welded or otherwise secured to the inner legs 44 and providing support for the plate 48 forming the base of the U and secured as by welding to the upper portion of legs 46. The plate 48 is formed with a longitudinal groove 49 extending substantially the length between the ends of the plate 48. The spaced portions of the plate 48 form the rails 26 upon which the dolly assemblies 22 and 24 roll.

The dolly assemblies 22 and 24 are essentially identical in structure and accordingly a description of one will suffice for the other. The dolly assembly 24 is best shown in FIGS. 1, 3 and 4 and is formed with an inverted U-shaped housing 50 having a top 52 and sides 54 that extend down from the top 50 so as to overhang rail 26 down to substantially adjacent legs 44.

Mounted for rotation within said housing 50 are two pairs of rollers 56,56 and 58,58 mounted for rotation about their respective axles 60 and 62. The axles 60 and 62 are mounted to the sides 54 so that the rollers 56 and 58 rotate freely about their respective shafts within the housing 50. Rollers 56 and 58 have the shape of railroad wheels in that they each have a surface 64 that is concentric to their respective axle 60 and 62. It is this surface 64 that is in rolling contact with the rails 26. The wheel is also provided with an upstanding rim 66 on the outer surface 64 of the wheel. The rim 66 is designed to extend beyond the edge of plate 48 of the rails 26 to keep the wheels and therefore the dolly 24 on rails 26. As best shown in FIGS. 3 and 4 a single pair of retainer wheels 68 is positioned in the sides 54 through the use of stub shaft 70 on each of the sides 54,54 for rolling contact with the underside 72 to maintain the dolly 24 onto the rail 26.

Figure 3A:
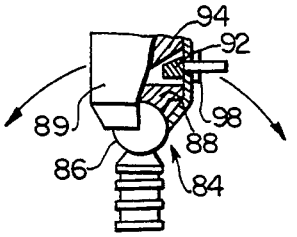
FIG. 3A is a side elevational view in magnification of the ball and socket connection between the base of the seat and the height adjusting vertical axis.
Figure 3:
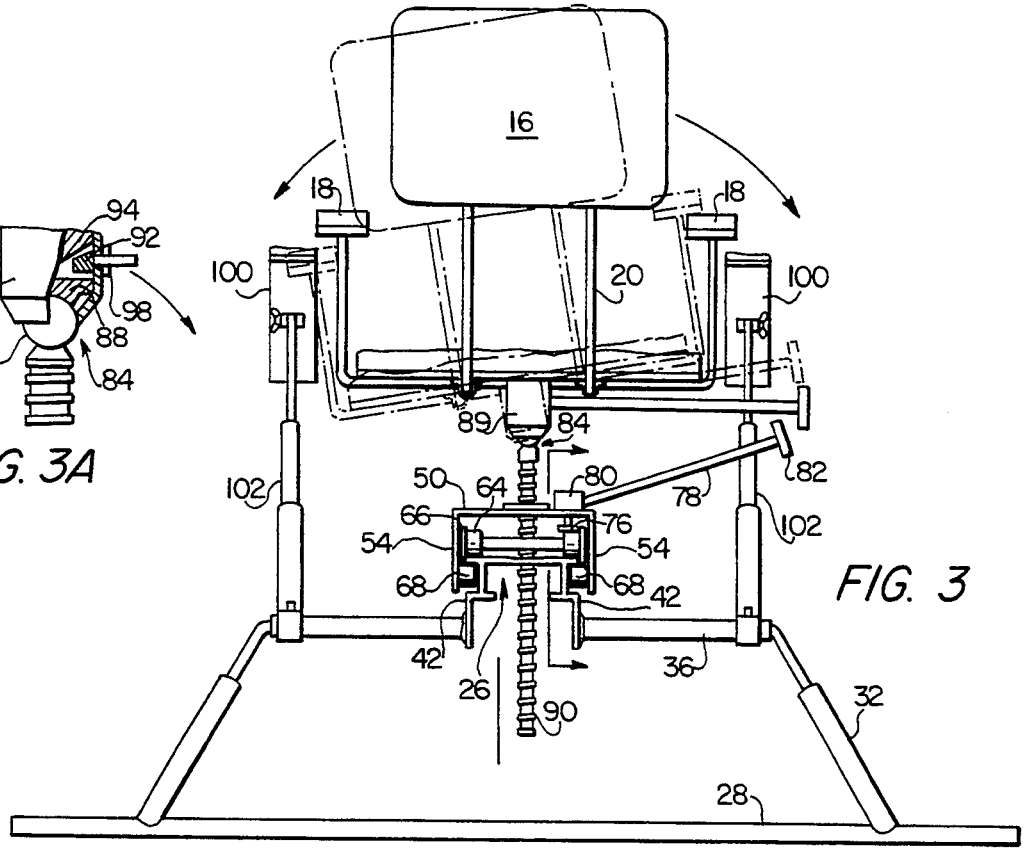
FIG. 3 is an end view looking at the end on the left side of FIG. 1 and illustrating the pivoting movement capability along with the track mechanism for reciprocal movement and the height adjustment.
Figure 4:
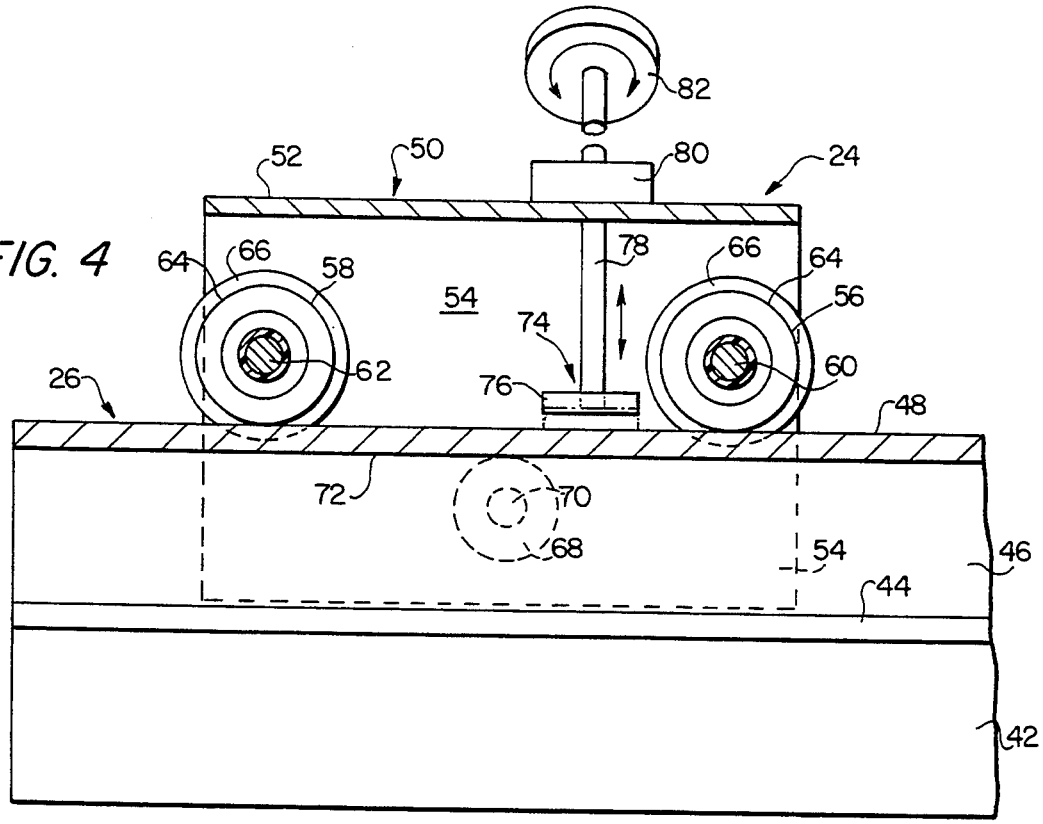
FIG. 4 is a cross-sectional view taken along lines 4—4 of FIG. 3 and illustrating the roller mechanism to permit the reciprocal movement of at least one of the seats and also showing the stop mechanism for holding the dolly in fixed position relative to the track.

As shown in FIGS. 3 and 4, brake mechanism 74 is provided with a sliding resistant material such as rubber in the form of a pad 76 that is positioned at the end of shaft 78 that moves up and down through housing 50 by reason of gearing not shown in housing 80 mounted on housing 50 and operated by rotating knob 82 to raise or lower the brake pad 76 to move it into contact with plate 48 and therefore hold the dolly in position along the rail 26.

The seats 12 and 14 are supported by a pivoting mechanism 84 best shown in FIGS. 3 and enlarged view 3A. The pivoting mechanism 84 as shown is a ball 86 and socket 88 arrangement in a housing 89. The ball 86 is secured at the end of a vertical screw 90 that is threaded through the top 52 of the housing 50 and passes through groove 49 to permit the dollies 22 and 24 to move longitudinally along the rails 26. The fact that the seat is supported by the screw 90 allows the seat to be raised or lowered as desired simply by threading the screw up or down through the housing 50.

The pivoting mechanism 84, made up of the ball 86 and socket 88, allows the seat that is conventionally secured to the housing 89 for the socket 88 to pivot in any direction such that a given point on the plane of the seat is capable of generating a spherical surface. The ball and socket arrangement may be locked so that the seat is held in any position desired by reason of the movement of the wedge 92 being cammed off stationary inclined surface 94 to force socket 88 downwardly into contact with ball 86. Wedge 92 is operated by means of shaft 96 threaded through the side of the pivoting mechanism at 98.

Figure 2:
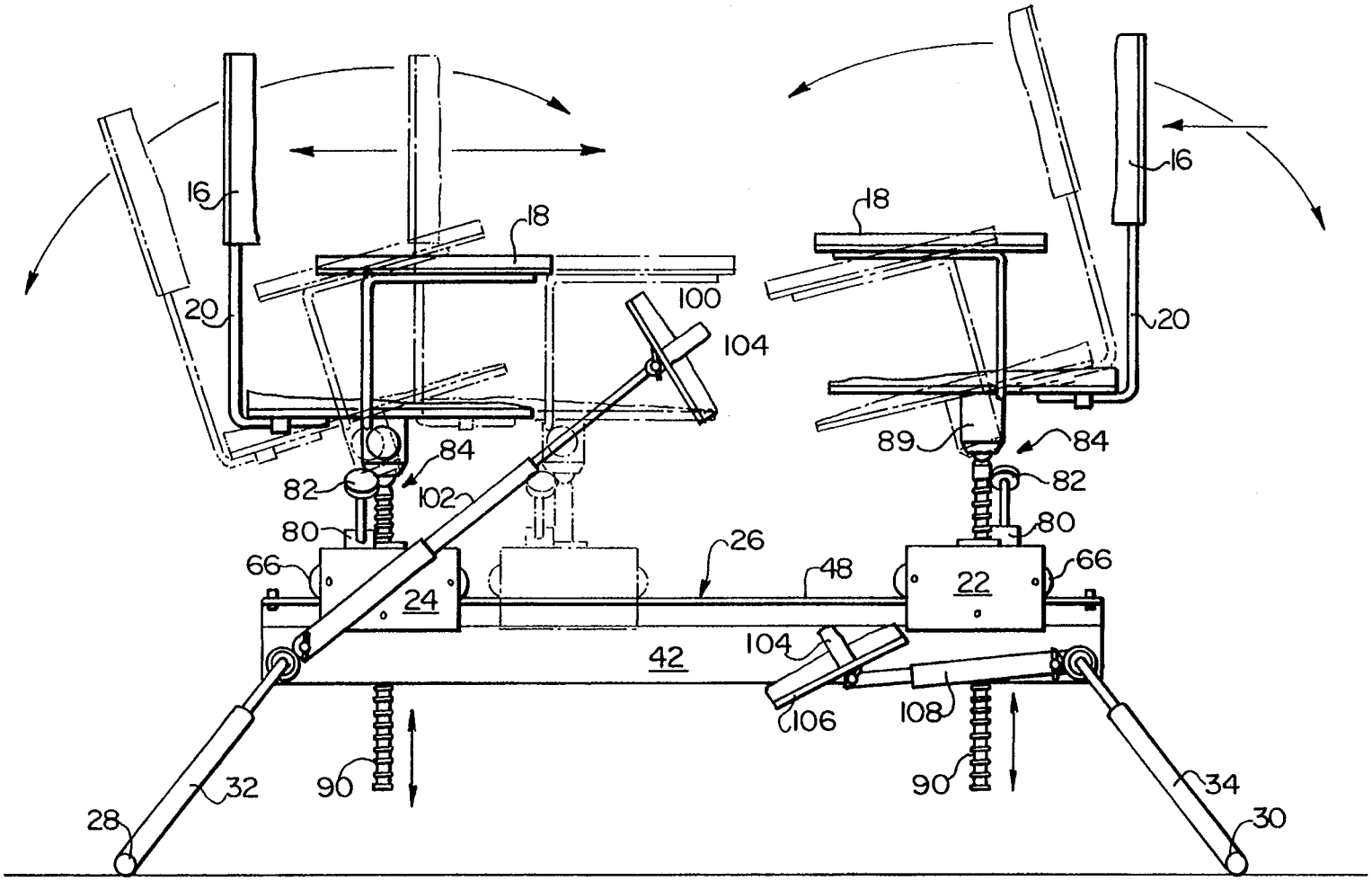
FIG. 2 is a side elevational view partly in phantom illustrating the various positions attainable by either of the seats for the couple and also illustrating the reciprocal movement capabilities.

As best shown in FIGS. 1 and 2, footrests for the occupants of each seat are provided. For the woman on seat 12, footrests 100 are secured at the end of extensible rods 102 and secured at the opposite end to horizontal support rods 36. The footrests 100 are provided with foot straps 104. The footrests 100 are angled upwardly and are on each side of the rail 26 extended outwardly. The position for the woman sitting in seat 12 is to have her feet directed upwardly and spaced widely apart. The footrest for the male seated in seat 14 is shown at 106 at the end of extensible rods 108 and is provided with the same foot strap 104 to hold the foot in place. As shown the footrest for the male is positioned below the rail 26 and spaced closer to the rails as shown in FIG. 1.

In operation the man and woman sit in their respective seats 14 and 12 and are able to move longitudinally forward and backward on the rail 26 to effect a reciprocating movement toward and away from each other. The footrest 106 used by the male allows control of his position anywhere along the rail. The footrests 100 for the female provide the woman with support and leverage to maintain an advantageous position relative to the man. The woman's seat 12 is preferably elevated by means of screw 90 to a position somewhat higher than that of the male seated in seat 14. When each occupant of each seat has placed their feet in their respective footrest the man's legs are directed forwardly towards the female separated by the width of the rail 26. The woman seated in seat 12 and higher than the man has her legs astride and over that of the man. Until the brake 74 is made operable to control the longitudinal reciprocating movement of the dolly 24, the man may bring his seat forwardly until coitus occurs. Even during the act of coitus either occupant of either chair may permit the respective dolly to move in a reciprocating movement while at the same time either occupant of either chair may pivot or move by reason of the pivoting mechanism so that each party may control their own movements selectively and continually as may be their choice.

It is an important element of the present invention that support for the body of the male and female occupants of their respective seats would be supported by the chair and armrests are provided along with the backrests if necessary to support the weight and thus reduce substantially the effort usually necessary for those engaging in intercourse.

It is believed that the objects and goals of the present invention have been achieved through the carefully set forth description of the invention given above and it is therefore intended that the invention be solely limited in scope by the appended claims wherein I claim:

1. An intimacy chair assembly to assist a human male and female couple to engage in sexual intercourse with reduced effect of gravity or the reduced expenditure of substantial energy comprising:

a seat for each of said female and male of said couple operatively associated with said assembly, said male and female seats positioned to substantially face each other, means positioned on said assembly for reciprocating movement of each seat independently of the other seat and selectively continually toward and away from the other seat in a substantially longitudinal direction, means positioned on said assembly and connected to each of said seats for independently and selectively continually pivoting each seat about a horizontal axis relative to the other seat, whereby said couple seated upon said seats may control their engagement in sexual intercourse while substantially supported by the seats thereby reducing the amount of energy required or the body control necessary.

2. The intimacy chair of claim 1 including said means for reciprocating movement and said means for pivoting each seat being capable of selective simultaneous and continuous pivoting and reciprocating movement.

3. The intimacy chair of claim 1 including, said means for selectively continually pivoting each seat being a ball and socket joint.

4. The intimacy chair of claim 3 including, said ball and socket joint being so structurally arranged so as to permit a given point on the plane of each seat to generate selectively continually a spherical surface.

5. The intimacy chair of claim 4 including, said reciprocating movement and said generation of a spherical surface being selectively performed simultaneously.

6. The intimacy chair of claim 1 including, stationary support means on said assembly for one or more extremities of at least one person of said couple.

7. The intimacy chair of claim 1 including, said means for reciprocating movement and said means for pivoting each seat being capable of selective simultaneous and continual pivoting and reciprocating movement, and said means for selectively continually pivoting each seat being a ball and socket joint.

8. The intimacy chair of claim 1 including, said means for reciprocating movement and said means for pivoting each seat being capable of selective simultaneous and continual pivoting and reciprocating movement, said means for selectively continually pivoting each seat being a ball and socket joint, said ball and socket joint being so structurally arranged so as to permit a given point on the plane of said seat to generate selectively continually a spherical surface, and said reciprocating movement and said generation of a spherical surface being selectively performed simultaneously.

9. The intimacy chair of claim 1 including, said seats being concave in a mutually facing direction.

10. The intimacy chair assembly of claim 1 including, elevation means connected to each seat to maintain one seat for the female in a higher vertical position than the other seat for the male.

11. The intimacy chair assembly of claim 10 including, said elevation means, and said means for reciprocating movement cooperating to permit the female in one seat for the female to be above and astride the male in the other seat.

12. The intimacy chair assembly of claim 1 including said means for reciprocating movement and said means for pivoting each seat being capable of selective simultaneous and continuous pivoting and reciprocating movement, and elevation means connected to each seat maintain one seat for the female in a higher vertical position than the other seat for the male.

13. The method of assisting a human male and female couple to engage in sexual intercourse with reduced effect of gravity or the reduced expenditure of substantial energy by either person comprising, providing a seat for each of said male and said female of said couple on a stationary assembly, supporting said male and female couple on their respective male and female seats, facing said seats toward each other, reciprocating said seats independently of said other seat and selectively continually toward and away from each other in a horizontal direction, independently and selectively continually pivoting each said seat about a horizontal axis relative to said other seat, allowing at least one of said couple to control said reciprocating or said pivoting during said sexual intercourse.

14. The method of claim 13 including, simultaneously reciprocating and pivoting at least each seat.

15. The method of claim 13 including, permitting said pivoting to selectively continually generate a spherical surface by a given point on the plane of each seat.

16. The method of claim 13 including, supporting at least one extremity of at least one of said couple in a stationary position relative to said assembly.

17. The method of claim 13 including, simultaneously reciprocating and pivoting each seat, and permitting said pivoting to selectively continually generate a spherical surface by a given point on the plane of each seat.

18. The method of claim 13 including, simultaneously reciprocating and pivoting each seat, permitting said pivoting to selectively continually generate a spherical surface by a given point on the plane of each seat, and supporting at least one extremity of at least one of said couple in a stationary position relative to said assembly.

19. The method of claim 13 including, elevating said female seat to a higher vertical position than the male seat.

20. The method of claim 13 including, adjusting the elevating and reciprocating to permit the female in said female seat to be higher than the male in the male seat and astride the male.

21. The method of claim 13 including, said means for reciprocating movement and said means for pivoting each seat being capable of selective simultaneous and continuous pivoting and reciprocating movement, elevation means connected to each seat to maintain one seat for the female in a higher vertical position than the other seat for the male, elevating said female seat to a higher vertical position than the male seat, and adjusting the elevating and reciprocating to permit the female in said female seat to be higher than the male in the male seat and astride the male.

22. An intimacy chair assembly to assist a human male and female couple to engage in sexual intercourse with reduced adverse effect of gravity or the reduced expenditure of substantial energy comprising:

a seat for each of said male and female of said couple operatively associated with said assembly, said male and female seats positioned to face each other, means positioned on said assembly for reciprocating movement of each seat independently of said other seat and selectively continually toward and away from the other seat in a substantially longitudinal direction, means positioned on said assembly and connected to each seat for independently and selectively continually pivoting each seat about a horizontal axis relative to the other seat, elevation means positioned on said assembly and connected to each seat for selectively varying the height each seat independently and relative to the other, whereby said couple seated upon said seats may control their engagement in sexual intercourse while substantially supported by the seats thereby reducing the amount of energy required or the body control necessary.

23. The intimacy chair of claim 22 including said means for reciprocating movement and said means for pivoting each seat being capable of selective simultaneous and continual pivoting and reciprocating movement.

24. The intimacy chair assembly of claim 22 including, said elevation means, and said means for reciprocating movement cooperating to permit the female in one seat to be above and astride the male in the other seat.

25. The intimacy chair assembly of claim 24 including, said elevation means maintaining said one seat of said female in a higher vertical position than the other seat for the male.

* * * * *